United States Patent [19]

Seabrook

[11] 4,186,667

[45] Feb. 5, 1980

[54] MULTI-PURPOSE PALLET

[76] Inventor: Terence D. Seabrook, 944-956 South Rd., Edwardstown, Australia

[21] Appl. No.: 911,965

[22] Filed: Jun. 2, 1978

[51] Int. Cl.[2] ..... B65D 19/30

[52] U.S. Cl. ..... 108/53.5; 108/54.1; 108/69

[58] Field of Search ..... 108/53.5. 55.1, 56.1, 108/54.1, 51.1, 53.1, 53.3, 52.1, 55.3, 55.5, 56.3, 57.1, 65, 69, 152; 206/386, 598–600; 220/4 F

[56] References Cited

U.S. PATENT DOCUMENTS

| | | | |
|---|---|---|---|
| 2,498,414 | 2/1950 | Gondar | 108/53.5 X |
| 2,972,463 | 2/1961 | Matthews et al. | 108/54.1 |
| 3,259,082 | 7/1966 | Williams | 108/152 |
| 4,002,126 | 1/1977 | Bell et al. | 108/53.5 |

FOREIGN PATENT DOCUMENTS

| | | | |
|---|---|---|---|
| 1038482 | 9/1958 | Fed. Rep. of Germany | 108/54.1 |
| 1089616 | 3/1955 | France | 108/53.5 |
| 1215619 | 4/1960 | France | 108/53.5 |
| 1357083 | 2/1964 | France | 108/53.5 |
| 1360683 | 7/1974 | United Kingdom | 108/53.5 |

*Primary Examiner*—William E. Lyddane
*Attorney, Agent, or Firm*—Norbert P. Holler

[57] ABSTRACT

A multi-purpose pallet is provided with a base frame and a load frame spaced from the base frame by tubular spacers, side frames which can be inserted into the tubular spacers and a pair of rails which can engage the side frames and hold them in position so that the pallet may be used either as a flat pallet or a container. In another aspect the pallet is provided with two outriggers projecting from it, each outrigger having projecting beams which engage the load frame bearer and a bearer which engages the load frame.

7 Claims, 5 Drawing Figures

MULTI-PURPOSE PALLET

This invention relates to a multi-purpose pallet which, in one of the aspects of the invention, can be used as a flat pallet for the handling of goods, in another aspect as a pallet container, or which in a still further aspect can be extended to be used as a flat pallet of larger dimension.

BACKGROUND OF THE INVENTION

In industry one of the difficulties encountered in pallets is their inflexibility, in that they cannot be used for general purposes. There is a well recognized need to have containers which can be used as pallets, but attempts which have been made to provide such dual purpose products have heretofore met with only limited success, and the main object of this invention is to provide a pallet having demountable side walls which will make a satisfactory container, that is, a container which will have relatively rigid sides and which will withstand normal wear and tear without losing its demountable facility.

BRIEF SUMMARY OF THE INVENTION

Briefly in this invention there is provided, in a pallet having upright tubular spacers between a base frame and a load frame, a pair of side frames inserted into the upper ends of the tubular spacers and a pair of end rails which engage the side frames and hold them in position, arranged so that the pallet may be used as a flat pallet or as a container.

Specifically, in one aspect of the invention a pallet has a base frame, a load frame, a pair of side frames, and a pair of end rails, a plurality of spacers joining the base frame to the load frame, said spacers comprising tubular section corner members extending vertically and constituting sockets, each said side frame having posts the depending ends of which are releasably insertable in respective said sockets to be supported thereby to be upstanding therefrom, each end rail having retaining means releasably interengageable with the side frames and operable to retain the upper ends of the side frames in spaced relationship with each other.

Another problem encountered with pallets is that different products require different platform sizes, and a further object of this invention is to provide improvement whereby a pallet can be extended to become of larger dimension.

In another aspect of the invention the pallet is provided with two outriggers, each outrigger having projecting beams which engage a load frame bearer, and a bearer which engages the load frame. This then provides a very simple and effective means for extending the area of a pallet.

BRIEF DESCRIPTION OF THE DRAWINGS

An embodiment of the invention is described hereunder in some detail with reference to and is illustrated in the accompanying drawings, in which.

DETAIL DESCRIPTION OF THE PREFERRED EMBODIMENT

Figure 1:
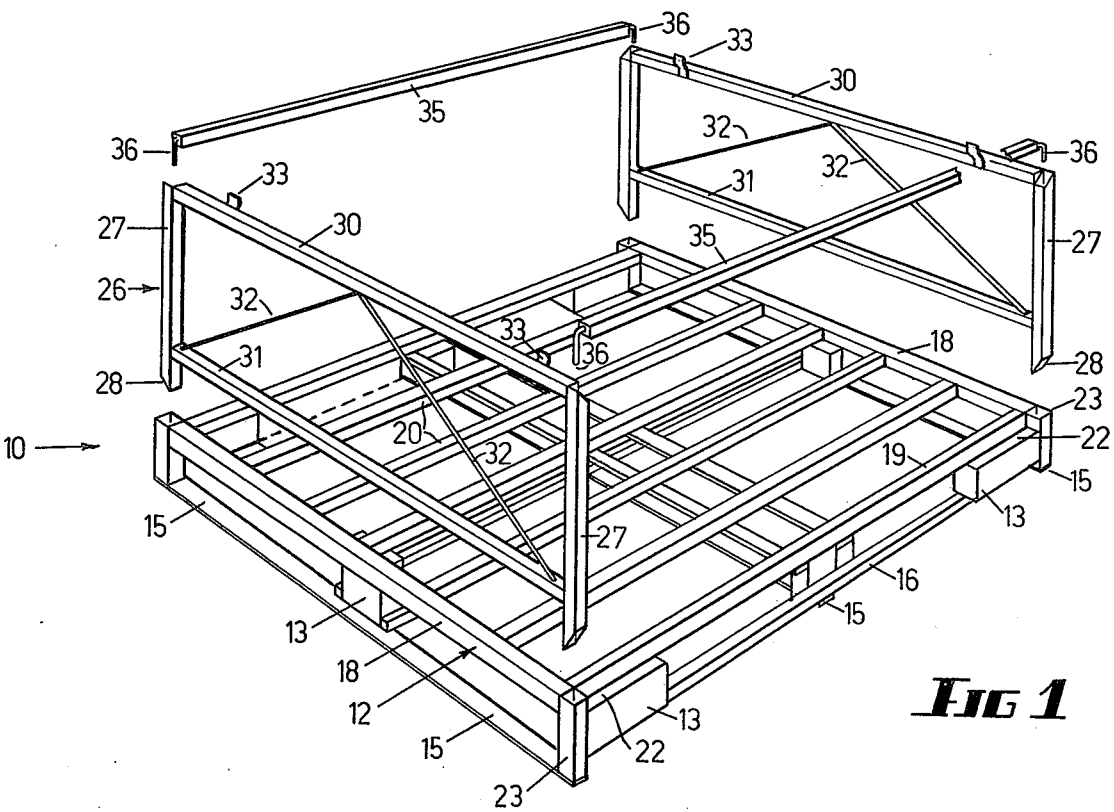
FIG. 1 is an "exploded" view of a pallet which embodies the first aspect of the invention, including a base frame, a load frame, a pair of side frames and a pair of end rails.
Figure 3:
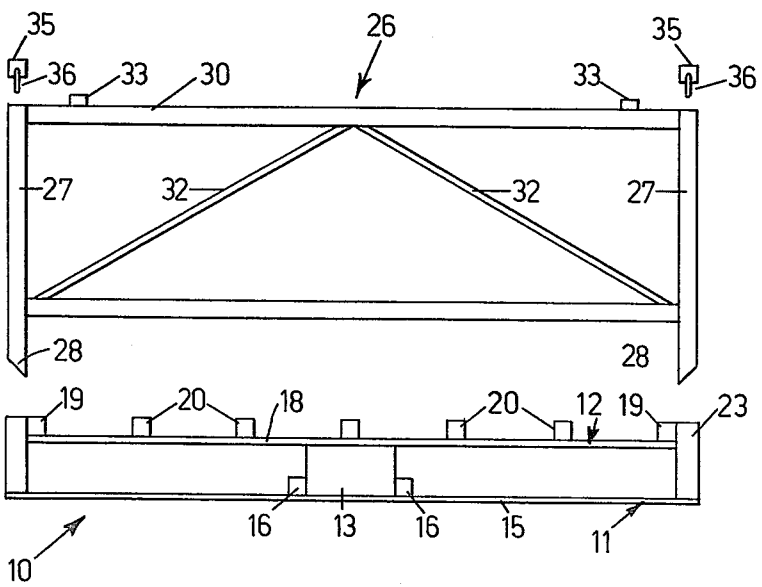
FIG. 3 is a side elevation taken in the direction of arrow "3" on FIG. 1.
Figure 2:
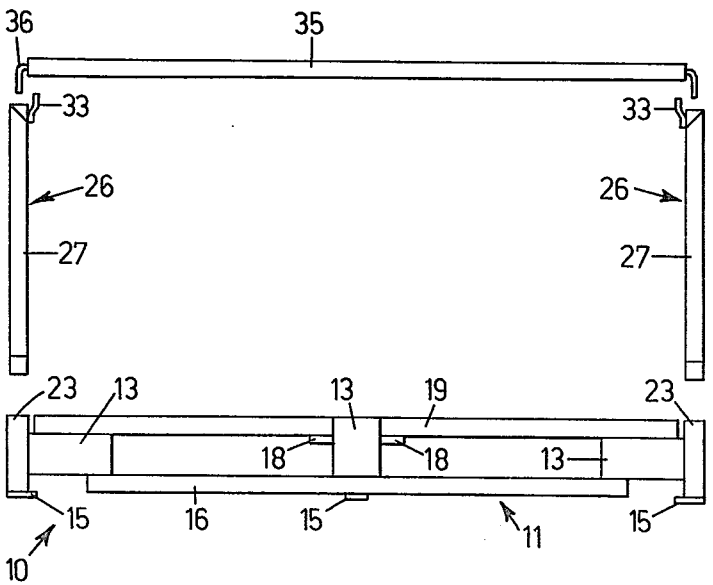
FIG. 2 is an end elevation taken in the direction of arrow "2" on FIG. 1.

In this embodiment a pallet 10 is formed to have a base frame 11 (which is normally the ground-engaging frame) and a load frame 12 (which normally supports a load), there being tubular spacers 13 between the frames 11 and 12.

The base frame 11 comprises three parallel bars 15 which are flat members arranged to lie on the ground and thereby enable a jacking truck to ride over them to get beneath the pallet in one direction only, and end rails 16 of tubular section positioned adjacent the ground so as to allow entry of the forks of a fork lift truck (even though they will not allow entry of a jacking truck).

The load frame 12 comprises side rails 18 formed from rectangular section tubing and end rails 19 formed from square section tubing, there being intermediate bearers 20 between the end rails also of square tubing and of similar section to the end rails. The spacers 13 which join the load frame and base frame are also of rectangular section tubing but are relatively short in length. The spacers 13 at the corners of the end rails project outwardly to provide support shelves 22 at each corner of the pallet as seen best in FIG. 1. Each corner is also provided with an upstanding square tubular socket 23 which functions as a socket for receiving the lower end of a frame post of a side frame.

Each side frame 26 is a substantially rectangular frame having two posts at its ends which are insertable within respective sockets 23 at the corners of the pallet. The upper end of each post 27 forms a tubular socket, and its lower end is chamfered at 28. Each side frame 26 has a upper rail 30 and a lower rail 31 both of which are of rectangular section tubing, and circular section bracing struts 32 join the rails 30 and 31. Each rail 30 has a pair of upwardly and inwardly sloping locating lugs 33 thereon, which abut against and thereby locate side bars 15 of another pallet when stacked.

Each end rail 35 is provided with a pair of depending spigots 36 each of which enters a socket constituted by the upper end of a respective side frame post 27. This prevents inward displacement of the upper ends of both the side frames and end frames. The lower ends of the side frames are prevented from displacement in any direction by virtue of the spigot and socket connections. The construction described above is found to give a suprisingly rigid structure when the end rails and side frames are positioned on the pallet base and load frames to form therewith a pallet container. Furthermore the bearers can support a planar sheet of material (for example cardboard).

Figure 4:
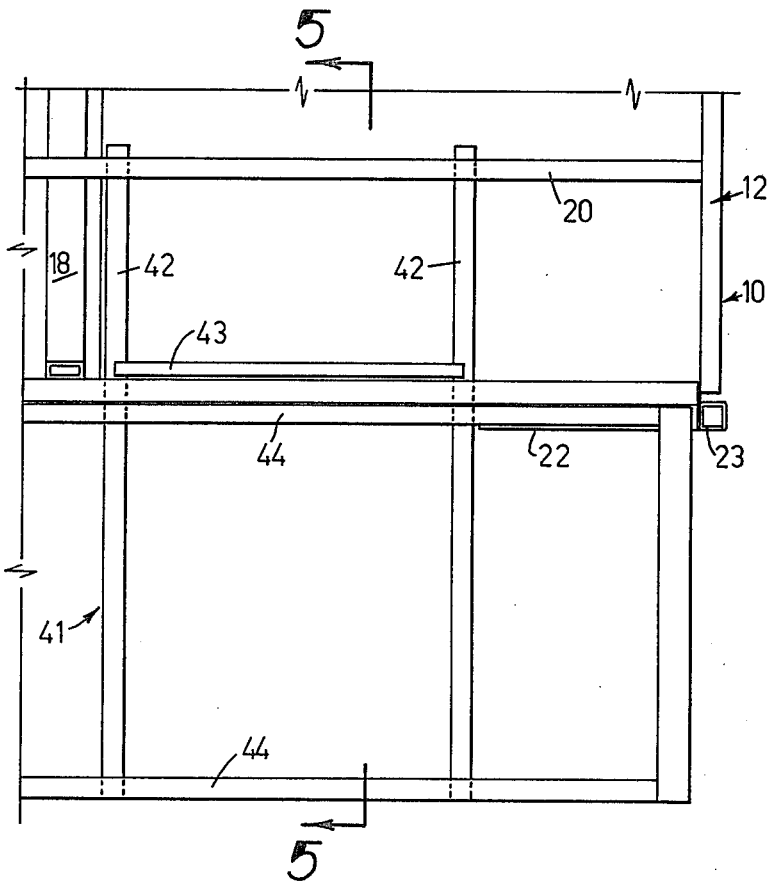
FIG. 4 is a fragmentary plan illustrating an outrigger on the load frame.
Figure 5:
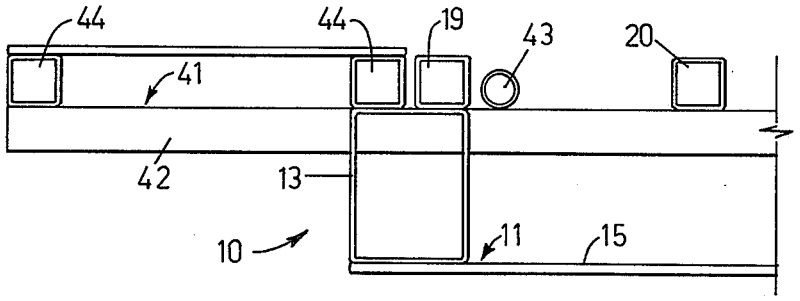
FIG. 5 is a corresponding fragmentary side elevational section taken on line 55 of FIG. 4.

The invention however extends in one of its aspects beyond a pallet container as described above and in another aspect of the invention illustrated in FIGS. 4 and 5, there are provided outriggers 41 which are rectangular frames having projecting beams 42 extending inwardly toward one another from opposite ends of base frame 11. The projecting beams 42 lie beneath the end rails 19 and bearers 20, and carry on them tubular section retainers 43, the beams 42 of each outrigger also having thereon a pair of bearers 44, the arrangement being such that a bearer of each outrigger is supported by the support shelves 22 on the ends of the pallet base frame, and a bearer 44 abuts the outer side surface of respective end rails 19 of the load frame of the pallet base as shown in FIG. 5. The tubular section retainers 43 abut the inner faces of the square end rails 19 of the pallet base to prevent outward displacement of the outriggers. End-wise displacement is prevented by abutment of the ends of the bearers 44 against the rectangular tubular sockets 23 of the pallet base.

The invention will be seen to be very simple, but notwithstanding its simplicity the invention results in an effective multi-purpose pallet which can be used as a four-way pallet for fork lift trucks, a two-way pallet for jacking trucks, a container, or an extensible pallet.

I claim:

1. A pallet having a base frame, a load frame, a pair of side frames, and a pair of end rails, a plurality of spacers joining the base frame to the load frame, said spacers comprising tubular section corner members extending vertically and constituting sockets, each said side frame having posts with depending ends releasably insertable in respective said sockets to be supported thereby to be upstanding therefrom, each said end rail having retaining means releasably interengageable with the side frames and operable to retain the upper ends of the side frames in spaced relationship with each other, support shelves provided on said corner spacers, a pair of outrigger frames releasably engageable with the load frame and arranged to project outwardly from the ends thereof, each outrigger frame having projecting beams which lie beneath the load frame, a bearer interconnecting the beams of each outrigger frame, said bearer having end portions which are restable upon a pair of said shelves.

2. A pallet according to claim 1 wherein the upper end of each said side frame post itself forms a socket, and each said end rail retaining means comprises a spigot insertable within and engageable by the walls of said socket.

3. A pallet according to claim 1 wherein said base frame comprises a plurality of flat bars arranged to engage the ground, and tubular section end rails at right angles thereto, the base frame end rails being adjacent the ground.

4. A pallet according to claim 1 wherein said load frame comprises load frame side rails and end rails, and a plurality of intermediate bearers parallel to the end rails and carried by the side rails.

5. A pallet according to claim 1 wherein each said side frame is a rectangular frame, and comprises bracing struts.

6. A pallet according to claim 8 wherein said outrigger frames each include a retainer spaced from said bearer to abut said load frame and prevent outward displacement of said outrigger frames beyond the releasably engageable position.

7. A pallet according to claim 8 wherein the end portions of said bearer abut said tubular sections to prevent endwise displacement of said outrigger frames beyond the releasably engageable position.

* * * * *